US009315760B2

(12) United States Patent
Chase et al.

(10) Patent No.: US 9,315,760 B2
(45) Date of Patent: Apr. 19, 2016

(54) ASHLESS LUBRICANT COMPOSITION

(71) Applicant: VANDERBILT CHEMICALS, LLC, Norwalk, CT (US)

(72) Inventors: Kevin J. Chase, Branford, CT (US); Brian W. Stunkel, Stamford, CT (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 0 days.

(21) Appl. No.: 14/531,496

(22) Filed: Nov. 3, 2014

(65) Prior Publication Data

US 2015/0087568 A1 Mar. 26, 2015

Related U.S. Application Data

(63) Continuation-in-part of application No. 12/695,709, filed on Jan. 28, 2010, now abandoned.

(60) Provisional application No. 61/149,067, filed on Feb. 2, 2009.

(51) Int. Cl.

| | |
|---|---|
| ***C10M 141/00*** | (2006.01) |
| ***C10M 141/08*** | (2006.01) |
| ***C10M 141/04*** | (2006.01) |
| *C10M 135/18* | (2006.01) |
| *C10M 141/02* | (2006.01) |

(52) U.S. Cl.

CPC ..... *C10M 141/08* (2013.01); *C10M 141/04* (2013.01); *C10M 135/18* (2013.01); *C10M 141/00* (2013.01); *C10M 141/02* (2013.01); *C10M 2205/0285* (2013.01); *C10M 2215/064* (2013.01); *C10M 2215/221* (2013.01); *C10M 2219/02* (2013.01); *C10M 2219/022* (2013.01); *C10M 2219/066* (2013.01); *C10M 2219/085* (2013.01); *C10N 2230/10* (2013.01); *C10N 2230/40* (2013.01); *C10N 2250/10* (2013.01)

(58) Field of Classification Search

CPC ..... C10M 135/18; C10M 141/00; C10M 141/02; C10M 141/08; C10M 2215/064; C10M 2215/221; C10M 2219/066; C10N 2230/10

See application file for complete search history.

(56) References Cited

U.S. PATENT DOCUMENTS

| | | | | |
|---|---|---|---|---|
| 4,880,551 | A | 11/1989 | Doe | |
| 5,073,278 | A | 12/1991 | Schumacher et al. | |
| 5,268,113 | A | 12/1993 | Evans | |
| 5,273,669 | A * | 12/1993 | Schumacher et al. | 508/251 |
| 5,278,314 | A | 1/1994 | Winter | |
| 5,840,672 | A | 11/1998 | Gatto | |
| 6,599,865 | B1 * | 7/2003 | Esche et al. | 508/254 |
| 6,743,259 | B2 | 6/2004 | Ginn | |
| 6,743,759 | B2 † | 6/2004 | Stunkel | |
| 2006/0019838 | A1 | 1/2006 | Muir | |
| 2007/0254821 | A1 | 11/2007 | Aguilar et al. | |
| 2008/0221000 | A1 | 9/2008 | Chase et al. | |
| 2008/0221050 | A1 | 9/2008 | Mashima | |
| 2009/0011961 | A1 | 1/2009 | Dong et al. | |
| 2010/0197537 | A1 * | 8/2010 | Chase et al. | 508/262 |
| 2010/0287821 | A9 | 11/2010 | Myllyoja et al. | |

OTHER PUBLICATIONS

Author: Dr. Junbing Yao; Title: The AO Synergistic Effects of VANLUBE 996E Antioxidant with VANLUBE BHC and VANLUBE 961 by Pressurized Differential Scanning Calorimitry; pp. 1-16; Publication Date: Jun. 2008; Published by Vanderbilt Chemicals, LLC; Place of publication not available.†

Author: R.T. Vanderbilt Holding Company, Inc.; Title: Vanderbilt Chemicals Technical Data, VANLUBE 7723; pp. 1-3; Published Mar. 19, 2013; Published by R.T. Vanderbilt Holding Company; Place of publication not available.†

* cited by examiner
† cited by third party

*Primary Examiner* — Taiwo Oladapo
(74) *Attorney, Agent, or Firm* — Norris McLaughlin & Marcus PA

(57) ABSTRACT

A lubricant composition with improved antioxidant capability is provided by way of an additive composition containing a metal free sulfur-containing compound, an aromatic amine, and a hindered amine. Particularly effective metal-free sulfur-containing compounds include ashless dithiocarbamates, such as methylenebis(dibutyldithiocarbamate), and sulfurized fatty acids.

3 Claims, No Drawings

ASHLESS LUBRICANT COMPOSITION

The present application is a Continuation-in-Part application of U.S. application Ser. No. 12/695,709, filed on Jan. 28, 2010, which claims priority to U.S. Provisional Application No. 61/149,067, filed on Feb. 2, 2009.

The present invention relates to lubricant compositions that are stabilized from oxidation by the presence of a (a) metal-free sulfur-containing compound, (b) a hindered amine, and (c) an aromatic amine.

BACKGROUND OF THE INVENTION

1. Field of the Invention

This invention relates to lubricating oil compositions, their method of preparation and use. Specifically, this invention relates to lubricating compositions that contain an antioxidant additive comprising a metal-free sulfur-containing compound, a hindered amine and an aromatic amine.

2. Description of the Related Art

Oxidation is a major cause of the breakdown of lubricants. This results in a shortened lifespan of the lubricant, requiring more frequent changes, especially in demanding environments such as internal combustion engines.

Antioxidants have therefore played an important role as additives in lubricants in order to extend their useful life. Aryl amines (also called aromatic amines), especially secondary diarylamines, e.g., alkylated diphenylamines, phenothiazines, and alkylated N-naphthyl-N-phenylamines have been important additives to lubricating compositions. Also important have been phenolic compounds in retarding oxidation.

Other combinations of antioxidants have also been used. U.S. Pat. Nos. 5,073,278 and 5,273,669 to Schumacher et al. disclose the synergistic combination of aromatic amines and hindered amines in a lubricating oil. U.S. Pat. No. 5,268,113 to Evans et al. discloses the combination of a hindered amine with phenolic compounds.

Sulfurized organic compounds have also been shown to have antioxidant activity. U.S. Pat. No. 4,880,551 to Doe and U.S. Pat. No. 6,743,759 to Stunkel disclose the synergies between an ashless dithiocarbamate with triazole compounds. U.S. Pat. No. 6,806,241 discloses the synergy between an ashless dithiocarbamate, a molybdenum compound, and an alkylated diphenylamine.

SUMMARY OF THE INVENTION

We have discovered that a lubricant composition containing an additive comprising a metal free sulfur-containing compound, an aromatic amine, and a hindered amine can synergistically give antioxidant protection. More specifically, the invention provides for a lubricant composition which comprises a mineral or a synthetic base oil, a mixture of such oils, or a grease, and an antioxidant additive composition comprising (as weight percent of the total lubricant composition):

- at least one, metal-free sulfur-containing compound at between about 0.001 and 10%, preferably between about 0.1 and 1.0%, and most preferably at between about 0.25 and 0.5%;
- at least one hindered amine at between 0.001 and 10%, preferably between about 0.05 and 1.0%, and most preferably between about 0.1 and 0.5%; and
- at least one aromatic amine at between 0.001 and 10%, preferably between about 0.1 to 1.0%, and most preferably between about 0.25 and 0.5%.

Particularly effective metal-free sulfur-containing compounds include ashless dithiocarbamates, such as methylenebis(dibutyldithiocarbamate), and sulfurized fatty acids. In addition, the highest degree of synergy was noted with a relatively small amount of hindered amine in the additive, such as a preferred composition comprising about 0.1% hindered amine, about 0.4% aromatic amine, and about 0.5% metal-free sulfur-containing compound.

Accordingly, another embodiment of the present invention relates to a lubricating composition comprising at least 90% by weight of a lubricant basestock, and about 0.5 to 5 wt. %, preferably 1 to 4 wt. %, more preferably 2 to 3 wt %, of an antioxidant additive composition comprising:

(a) methylenebis(dibutyldithiocarbamate), (b) a hindered amine selected from the group consisting of 4-stearoyloxy-2,2,6,6-tetramethylpiperidine and di(1,2,2,6,6-pentamethylpiperidin-4-yl) sebacate;

(c) a diaryl amine, wherein the weight ratio of (a):(b):(c) is about 5:4:1.

DETAILED DESCRIPTION OF THE INVENTION

Lubricant Basestocks

Typical lubricant basestocks that can be used in this invention may include both mineral and synthetic oils. Included are polyalphaolefins, (also known as PAOS), esters, diesters and polyol esters or mixtures thereof. The basestock comprises at least 90%, and preferably at least 95% of the total lubricant composition.

Grease

Base grease compositions consist of a lubricating oil and a thickener system. Generally, the base oil and thickener system will comprise 65 to 95, and 3 to 10 mass percent of the final grease respectively. The base oils most commonly used are petroleum oils, bio-based oils or synthetic base oils. The most common thickener systems known in the art are lithium soaps, and lithium-complex soaps, which are produced by the neutralization of fatty carboxylic acids or the saponification of fatty carboxylic acid esters with lithium hydroxide typically directly in the base fluids. Lithium-complex greases differ from simple lithium greases by incorporation of a complexing agent, which usually consists of di-carboxylic acids.

Other thickener systems that can be used in this invention include aluminum, aluminum complex, sodium, calcium, calcium complex, organo-clay, sulfonate and polyurea, etc.

Metal-Free Sulfur-Containing Compounds

Sulfur-containing compounds used in this invention are of many types. Typically, the sulfur-containing compound is oil-soluble and contains a readily oxidizable sulfur atom or atoms. Examples of such compounds are sulfurized olefins, alkyl sulfides and disulfides, dialkyl dithiocarbamates, dithiocarbamate esters, ashless dithiocarbamates, thiuram disulfides, sulfurized fatty acids, sulfurized fatty acid derivatives, and thiadiazole compounds.

1. Sulfurized Fatty Acids and Derivatives

Sulfurized fatty acids can be prepared by the reaction with unsaturated fatty acids with the sulfur sources mentioned above. Examples of unsaturated fatty acids include but are not limited to; linoleic acid, oleic acid, arachidonic acid, linolenic acid, and myristoleic acid.

Derivatives of sulfurized fatty acids include but are not limited to sulfurized fatty acid esters and sulfurized fatty acid amides.

2. Other Sulfur-Containing Compounds

Ashless dithiocarbamates, tetraalkylthiuram disulfides, and thiadiazole compounds that are suitable for use in this invention include, but are not limited to; methylenebis(dialkyldithiocarbamate), ethylenebis(dialkyldithiocarbamate), and tetraalkylthiuram disulfide where the alkyl groups have preferentially have between 1 and 20 carbon atoms. Examples of preferred ashless dithiocarbamates are methylenebis(dibutyldithiocarbamate) and ethylenebis(dibutyldithiocarbamate). Examples of preferred thiuram disulfides include tetrabutylthiuram disulfide and tetraoctylthiuram disulfide. Examples of thiadiazole compounds include dialkyl thiadiazoles.

It is found that sulfurized olefins do not provide a noticeable synergy when used in the proposed three-component system of the invention. Sulfurized olefins are usually derived from alpha olefins, isomerized alpha olefins, cyclic olefins, branched olefins, and polymeric olefins that are reacted with a sulfur source. Specific examples of olefins include but are not limited to; 1-butene, isobutylene, diisobutylene, 1, pentene, 1-hexene, 1-heptene, 1-octene, and more with longer carbon chains up to $C_{60}$ and beyond to polymeric olefins. Examples of sulfur sources include sulfur, hydrogen sulfide, sodium hydrogen sulfide, sodium sulfide, sulfur chloride, and sulfur dichloride.

Hindered Amines

The hindered amines used in this invention are of many types, with three types predominating: pyrimidines, piperidines and stable nitroxide compounds. Many more are described in the book "Nitrones, Nitronates, and Nitroxides", E. Breuer, et al., 1989, John Wiley & Sons. The hindered amines are also known as HALS (hindered amine light stabilizers) and are a special type of amine that are capable of antioxidant behavior. They are used extensively in the plastics industry to retard photochemical degradation.

1. Pyrimidine Compounds

Pyrimidine compounds are of the substituted tetrahydro type and include the general structure of a 2,3,4,5 tetrahydropyrimidine as given below (I), and described by Volodarsky, et al. in U.S. Pat. No. 5,847,035, and by Alink in U.S. Pat. No. 4,085,104.

(I)

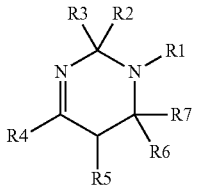

R1 is H, O, or a hydrocarbon from 1 to 25 carbon atoms, or an alkoxy radical with the oxygen bound to the nitrogen with the alkyl portion containing 1 to 25 carbon atoms. R2, R3, R4, R5, R6, and R7 are hydrocarbons with 1 to 25 carbon atoms each. Most preferably, R2, R3, R6, and R7 are methyls.

Other pyrimidine compounds that can are of the hexahydro type, (II)

(II)

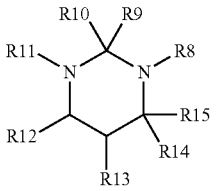

R8 and R11 are H, O, or a hydrocarbon from 1 to 25 carbon atoms, or an alkoxy radical with the oxygen bound to the nitrogen with the alkyl portion containing 1 to 25 carbon atoms. R9, R10, R11, R12, R13 R14, and R15 are hydrocarbons with 1 to 25 carbon atoms each. Most preferably, R9, R10, R14, and R15 are methyls.

2. Piperidine Compounds

The piperidine compounds used in this invention are described by Schumacher, et al., U.S. Pat. No. 5,073,278 and by Evans in U.S. Pat. No. 5,268,113. These compounds have the general formula (III);

(III)

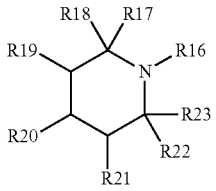

where R16 is H, O or a hydrocarbon from 1 to 25 carbon atoms, or an alkoxy radical with the oxygen bound to the nitrogen with the alkyl portion containing 1 to 25 carbon atoms. R17, R18, R22, and R23 are preferentially methyl groups. R20 is either OH, H, O, $NH_2$, an ester group $O_2CR$ where R is a hydrocarbon with 1 to 25 carbon atoms or a succinimide group.

Examples of hindered amines based upon piperidine include 4-hydroxy-2,2,6,6-tetramethylpiperidine, 1-allyl-4-hydroxy-2,2,6,6-tetramethylpiperidine, 1-benzyl-4-hydroxy-2,2,6,6-tetramethylpiperidine, 1-(4-tert-butylbut-2-enyl)-4-hydroxy-2,2,6,6-tetramethylpiperidine, 4-stearoyloxy-2,2,6,6-tetramethylpiperidine, 1-ethyl-4-salicyloyloxy-2,2,6,6-tetramethylpiperidine, 4-methacryloyloxy-1,2,2,6,6-pentamethylpiperidine, 1,2,2,6,6-pentamethylpiperidin-4-yl-(3,5-di-tert-butyl-4-hydroxyphenyl)propionate, di(1-benzyl-2,2,6,6-tetramethylpiperidin-4-yl) maleate, di(2,2,6,6-tetramethylpiperidin-4-yl) succinate, di(2,2,6,6-tetramethylpiperidin-4-yl) glutarate, di(2,2,6,6-tetramethylpiperidin-4-yl) adipate, di(2,2,6,6-tetramethylpiperidin-4-yl) sebacate, di(1,2,2,6,6-pentamethylpiperidin-4-yl) sebacate, di(1,2,3,6-tetramethyl-2,6-diethylpiperidin-4-yl) sebacate, di(1-allyl-2,2,6,6-tetramethylpiperidin-4-yl) phthalate, 1-hydroxy-4-.beta.-cyanoethoxy-2,2,6,6-tetramethylpiperidine, 1-acetyl-2,2,6,6-tetramethylpiperidin-4-yl acetate, tri(2,2,6,6-tetramethylpiperidin-4-yl)trimellitate, 1-acryloyl-4-benzyloxy-2,2,6,6-tetramethylpiperidine, di(2,2,6,6-tetramethylpiperidin-4-yl) diethylmalonate, di(1,2,2,6,6-pentamethylpiperidin-4-yl) dibutylmalonate, di(1,2,2,6,6-pentamethylpiperidin-4-yl)butyl(3,5-di-tert-butyl-4-hydroxybenzyl)malonate, di(1-octyloxy-2,2,6,6-tetramethylpiperidin-4-yl) sebacate, di(1-cyclohexyloxy-2,2,6,6-tetramethylpiperidin-4-yl) sebacate, hexane-1',6'-bis(4-carbamoyloxy-1-n-butyl-2,2,6,6-tetramethylpiperidine), toluene-2',4'-bis(4-carbamoyloxy-1-n-propyl-2,2,6,6-tetramethylpiperidine), dimethyl-bis(2,2,6,6-tetramethylpiperidin-4-oxy)silane, phenyl-tris(2,2,6,6-tetramethylpiperidin-4-oxy)silane, tris(1-propyl-2,2,6,6-tetramethylpiperidin-4-yl)phosphate, tris(1-propyl-2,2,6,6-tetramethylpiperidin-4-yl)phosphate, phenyl[bis (1,2,2,6,6-pentamethylpiperidin-4-yl)]phosphonate, 4-hydroxy-1,2,2,6,6-pentamethylpiperidine, 4-hydroxy-N-hydroxyethyl-2,2,6,6-tetramethylpiperidine, 4-hydroxy-N-(2-hydroxypropyl)-2,2,6,6-tetramethylpiperidine, 1-glycidyl-4-hydroxy-2,2,6,6-tetramethylpiperidine, dodecyl-N-(2,2,6,6,-tetramethyl-4-piperidinyl)succinate.

Most useful in this invention are the 2,2,6,6-tetramethylpiperidines, 1,2,2,6,6-pentaalkylpiperidines, 1-oxo-2,2,6,6-tetramethylpiperidines, and 1-alkoxy-2,2,6,6-tetramethylpiperidines.

3. Polymers Containing Hindered Amines

Polymeric 2,2,6,6-tetraalkylpiperidines and 1,2,2,6,6-pentaalkylpiperidines are also prevalent and may be used in this formulation. The polymeric compounds used in this invention are described by Schumacher, et al., U.S. Pat. No. 5,073,278, by Evans et al. in U.S. Pat. No. 5,268,113, and by Kazmierzak et al. in U.S. Pat. No. 4,857,595. There are several kinds of polymeric piperidine compounds available. Commercially available examples include Tinuvin® 622 from Ciba and Songlight® 9440 from Songwon.

4. Other Hindered Amines

Another type of hindered amine has been disclosed in U.S. Pat. No. 5,098,944 and describes hindered amines of the type shown in general formula (IV).

(IV)

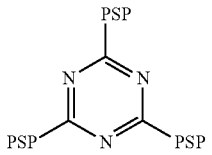

Wherein PSP represents a substituent derived from a cyclic amine represented by a structure selected from the group in general formulae (V)

(V)

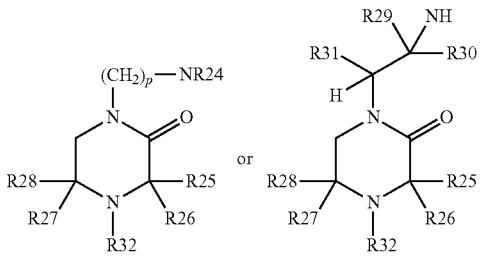

wherein PSP represents a substituent derived from a cyclic amine represented by a structure selected from the group consisting of wherein R24 represents $C_1$-$C_{24}$ alkyl, $C_5$-$C_{20}$ cycloalkyl $C_7$-$C_{20}$ aralkyl or alkaryl, $C_1$-$C_{24}$ aminoalkyl, or $C_6$-$C_{20}$ aminocycloalkyl; R25, R26, R27, and R28 independently represent $C_1$-$C_{24}$ alkyl; and R25 with R26, or R27 with R28 are cyclizable to $C_5$-$C_{12}$ cycloalkyl including the $C_3$ and $C_5$ atoms respectively, of the piperazin-2-one ring; R29 and R30 independently represent $C_1$-$C_{24}$ alkyl, and polymethylene having from 4 to 7 carbon atoms which are cyclizable; R31 represents H, $C_1$-$C_6$ alkyl, and phenyl; R32 represents $C_1$-$C_{25}$ alkyl, H, or O, or alkoxy with a hydrocarbon chain between 1 and 25 carbon atoms; and, p represents an integer in the range from 2 to about 10.

Diarylamines

The diarylamines used in this invention are of the type $Ar_2NR$. Since these are well known antioxidants in the art, there is no restriction on the type of diarylamines used in this invention, although there is the requirement of solubility in the lubricating composition.

(VI)

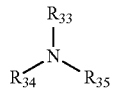

The alkylated diphenylamines are well known antioxidants and there is no particular restriction on the type of secondary diarylamine used in the invention. Preferably, the secondary diarylamine antioxidant has the general formula (X) where R33 and R34 each independently represents a substituted or unsubstituted aryl group having from 6 to 30 carbon atoms. R35 represents either a H atom or an alkyl group containing from 1 to 30 carbon atoms. Illustrative of substituents for the aryl there can be mentioned aliphatic hydrocarbon groups such as alkyl having from about 1 to 20 carbon atoms, hydroxy, carboxyl or nitro, e.g., an alkaryl group having from 7 to 20 carbon atoms in the alkyl group. The aryl is preferably substituted or unsubstituted phenyl or naphthyl, particularly wherein one or both of the aryl groups are substituted with an alkyl such as one having from 4 to 18 carbon atoms. R35 can be either H or alkyl from 1 to 30 carbon atoms. The alkylated diphenylamines used in this invention can be of a structure other than that shown in the above formula which shows but one nitrogen atom in the molecule. Thus, the alkylated diphenylamine can be of a different structure provided that at least one nitrogen has 2 aryl groups attached thereto, e.g., as in the case of various diamines having a secondary nitrogen atom as well as two aryls on one of the nitrogens. The alkylated diphenylamines used in this invention preferably have antioxidant properties in lubricating oils, even in the absence of the molybdenum compound.

Examples of some alkylated diphenylamines that may be used in this invention include: diphenyl amine, 3-hydroxydiphenylamine; N-phenyl-1,2-phenylened-amine; N-phenyl-1,4-phenylenediamine; dibutyldiphenylamine; dioctyldiphenylamine; dinonyldiphenylamine; phenyl-alpha-naphthylamine; phenyl-beta-naphthylamine; diheptyldiphenylamine; and p-oriented styrenated diphenylamine.

Phenothiazines

Phenothiazines are another class of diarylamines with the general structure (VII), (VII)

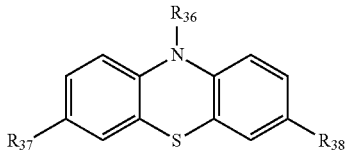

Where R36 is H, or an alkyl from 1 to 30 carbon atoms, and R37 and R38 are alkyl from 1 to 30 carbon atoms Lubricating Oil Compositions The lubricating oil compositions of this invention can be prepared by adding the sulfur-containing compound, the hindered amine, and the aromatic amine to a basestock. Combinations can contain from 0.001 to 10 weight percent of each of the three additives in the lubricating oil.

Grease Compositions

In another embodiment, a grease composition of this invention can be prepared by adding sulfur-containing compound, the hindered amine, and the aromatic amine to a base grease. Combinations can contain from 0.001 to 10 weight percent of each of the three additives in the lubricating oil.

Other Additives

In addition, other additives can be added to the lubricating compositions described above. These include the following components:

Other antioxidants, including phenols, hindered phenols, hindered bisphenols, sulfurized phenols, zinc dihydrocarbyl dithiosphosphates, zinc dithiocarbamates, organophosphites. A more complete list of useful phenols can be found in U.S. Pat. No. 5,073,278 to Schumacher et al.

Antiwear additives, including zinc dihydrocarbyl dithiophosphates, tricresol phosphate, dilauryl phosphate.

Dispersants, including polymethacrylates, styrenemaleic ester copolymers, substituted succinamides, polyamine succinamides, polyhydroxy succinic esters, substituted Mannich bases, and substituted triazoles.

Detergents, including neutral and overbased alkali and alkaline earth metal sulfonates, neutral and overbased alkali and alkine earth metal phenates, sulfuized phenates, overbased phosphonates, and thiophosphonates.

Viscosity index improvers, including polyacrylates, polymethacrylates, vinylpyrrolidone/methacrylate copolymers, polyvinylpyrrolidones, polybutesne, olefin copolymers, styrene/acrylate copolymers.

Pour point depressants, including polymethacrylate and alkylated naphthalene derivatives.

Example 1

Lubricant Compositions Containing a Hindered Amine, Diaryl Amine and Methylenebis(dibutyldithiocarbamate)

Pressurized Differential Scanning calorimetry (PDSC) was performed according to ASTM Test Method D6186. These tests were performed on a lubricant composition comprising a polyalphaolefin oil, Durasyn® 166 from BP, and Infineum® C9268, a crankcase dispersant containing 1.2% Nitrogen from Infineum. Also provided in the lubricant composition was Cyasorb® UV-3853, a hindered amine with the name 4-piperidol-2,2,6,6-tetremethyl-RPW stearin (fatty acids mixture) from Cytec. The metal-free sulfur containing compound is VANLUBE® 7723 additive, a methylenebis (dibutyldithiocarbamate) from R.T. Vanderbilt Company, Inc. The diaryl amine used was Vanlube® 961 additive from R.T. Vanderbilt Company, Inc., a mixture of octylated and butylated diphenylamines. The test is performed by blending and adding the ingredients into a DSC cell, heating the cell to 180 degrees C., then pressurizing with 500 psi of oxygen. What is measured is the oxidation induction time (OIT), which is the time takes to observe an exothermic release of heat. The longer the OIT the greater the oxidative stability of the oil blend. The results are shown in Table I labeled as "minutes to induction".

TABLE I

PDSC Induction Times for Motor Oil Blends
% Additive

| | | | | | | | | | |
|---|---|---|---|---|---|---|---|---|---|
| Cyasorb UV 3853 | | | 0.25 | | 0.25 | 0.25 | 0.10 | 0.25 | 0.50 |
| VL 961 | 0.50 | 0.25 | | | | 0.25 | 0.40 | 0.25 | |
| VL 7723 | 0.50 | 0.50 | | 0.50 | 0.50 | 0.50 | 0.50 | | |
| Infineum C9268 | 3.90 | 3.90 | 3.90 | 3.90 | 3.90 | 3.90 | 3.90 | 3.90 | 3.90 |
| Durasyn 166 | 95.10 | 95.35 | 95.85 | 95.60 | 95.35 | 95.10 | 95.10 | 95.60 | 95.60 |
| PDSC @180° C. 500 lbs $O_2$ 100 ml/min flow | | | | | | | | | |
| Minutes to induction | 268.6 | 206.9 | 48.0 | 16.0 | 25.2 | 229.7 | 335.7+ | 91.2 | 59.2 |

Example 2

Lubricant Compositions Containing a Hindered Amine, Diaryl Amine and a Sulfurized Fatty Acid Lubricant compositions prepared as above in Example 1, containing the combination of Cyasorb® UV-3853 and Vanlube® 961, and as sulfur-containing compound Arkema® VPS 15, a sulfurized fatty acid mixture containing approximately 15% sulfur (w/w) from Arkema. PDSC (ASTM D1686) was performed as in Example 1, and data is reported in Table II.

TABLE II

PDSC Induction Times for Motor Oil Blends
% Additive

| | | | | | | | |
|---|---|---|---|---|---|---|---|
| Cyasorb UV 3853 | | | | | 0.25 | 0.25 | 0.1 |
| VL 961 | 0.5 | 0.5 | 0.25 | | | 0.25 | 0.4 |
| Arkema VPS 15 | | 0.5 | 0.5 | 0.5 | 0.5 | 0.5 | 0.5 |
| Infineum C9268 | 3.9 | 3.9 | 3.9 | 3.9 | 3.9 | 3.9 | 3.9 |
| Durasyn 166 | 95.6 | 95.1 | 95.35 | 95.6 | 95.35 | 95.1 | 95.1 |
| PDSC @180° C. 500 lbs $O_2$ 100 ml/min flow | | | | | | | |
| Minutes to induction | 69.1 | 173.3 | 76.6 | 8.3 | 13.4 | 185.2 | 213.5 |

Comparative Example 3

Lubricant Compositions Containing a Hindered Amine, Diaryl Amine and a Sulfurized Olefin Lubricant compositions were prepared according to Example 1 above, containing the combination of Cyasorb UV3853 and Vanlube® 961, with sulfur-containing compound VANLUBE® SB, a sulfurized olefin containing approximately 45% sulfur from R.T. Vanderbilt Company, Inc. PDSC (ASTM D1686) was performed as in Example 1, and data is reported in Table III.

TABLE III

| PDSC Induction Times for Motor Oil Blends % Additive | | | | | | | |
|---|---|---|---|---|---|---|---|
| Cyasorb UV 3853 | | | | | 0.25 | 0.25 | 0.1 |
| VL 961 | 0.5 | 0.5 | 0.25 | | | 0.25 | 0.4 |
| VL SB | | 0.5 | 0.5 | 0.5 | 0.5 | 0.5 | 0.5 |
| Infineum C9268 | 3.9 | 3.9 | 3.9 | 3.9 | 3.9 | 3.9 | 3.9 |
| Durasyn 166 | 95.6 | 95.1 | 95.35 | 95.6 | 95.35 | 95.1 | 95.1 |
| PDSC @180° C. 500 lbs $O_2$ 100 ml/min flow Minutes to induction | 69.1 | 213.1 | 138.4 | 12.0 | 19.0 | 216.5 | 215.5 |

Example 4

Lubricant Compositions Containing a Sebacic Acid based Hindered Amine, Diaryl Amine, and Methylenebis(dibutyldithiocarbamate)

Lubricant compositions were prepared according to Example 1, containing the combination of sebacic acid based hindered amine, Bis(1,2,2,6,6-pentamethyl-4-piperidinyl)sebacate, sold under the trade name Songlight®2920LQ from Songwon, Vanlube® 961, and Vanlube® 7723. The hindered amine is a tertiary amine. PDSC (ASTM D1686) was performed as in Example 1.

TABLE IV

| | 1 | 2 | 3 | 4 | 5 | 6 | 7 | 8 |
|---|---|---|---|---|---|---|---|---|
| Songlight 2920LQ | 0.5 | | | 0.5 | | 0.25 | 0.25 | 0.1 |
| Vanlube 961 | | 0.5 | | | 0.5 | 0.25 | 0.25 | 0.4 |
| Vanlube 7723 (30% S) | | | 0.5 | 0.5 | 0.5 | | 0.5 | 0.5 |
| Infineum C9268 | 3.9 | 3.9 | 3.9 | 3.9 | 3.9 | 3.9 | 3.9 | 3.9 |
| Durasyn 166 | 95.6 | 95.6 | 95.6 | 95.1 | 95.1 | 95.6 | 95.1 | 95.1 |
| PDSC @180° C. 500 lbs $O_2$ 100 ml/min flow Minutes to induction | 33.2 | 49.8 | 3.4 | 4.3 | 215.5 | 83.3 | 198.8 | 245.9 |

Example 5

Lubricant Compositions Containing a Hindered Amine, Diaryl Amine and Methylenebis(dibutyldithiocarbamate) at High Concentrations Lubricant compositions were prepared as above in Example 1, containing the combination of Cyasorb® UV 3853 and Vanlube® 961 and Vanlube® 7723 at high concentrations of up to 2% of a single component. PDSC (ASTM D1686) was performed as in Example 1.

TABLE V

| | 9 | 10 | 11 | 12 | 13 | 14 | 15 | 16 |
|---|---|---|---|---|---|---|---|---|
| Cyasorb UV 2853 | 2 | | | 2 | | 1 | 1 | 0.4 |
| Vanlube 961 | | 2 | | | 2 | 1 | 1 | 1.6 |
| Vanlube 7723 (30% S) | | | 2 | 2 | 2 | | 2 | 2 |
| Arkema VPS 15 (15% S) | | | | | | | | |
| Infineum C9268 | 3.9 | 3.9 | 3.9 | 3.9 | 3.9 | 3.9 | 3.9 | 3.9 |

TABLE V-continued

| | 9 | 10 | 11 | 12 | 13 | 14 | 15 | 16 |
|---|---|---|---|---|---|---|---|---|
| Durasyn 166 | 94.1 | 94.1 | 94.1 | 92.1 | 92.1 | 94.1 | 92.1 | 92.1 |
| PDSC @180° C. 500 lbs $O_2$ 100 ml/min flow Minutes to induction | 55.5 | 101.6 | 39.7 | 16.3 | 264.9 | 86.4 | 66.1 | 316.6 |

Example 6

Lubricant Compositions Containing a Sebacic Acid based Hindered Amine, Diaryl Amine, and Sulfurized Fatty Acid at Low Concentrations Lubricant compositions prepared as above in Example 1, containing a combination of a sebacic acid based hindered amine, Bis(1,2,2,6,6-pentamethyl-4-piperindinyl) sebacate, sold under the trade name Songlight 2920LQ from Songwon, Vanlube 961, and sulfurized fatty acid, Arkema VPS 15. The combinations were performed at low concentrations, down to 0.05%. PDSC (ASTM 1686) was performed as in Example 1.

TABLE VI

| | 1 | 2 | 3 | 4 | 5 | 6 | 7 | 8 |
|---|---|---|---|---|---|---|---|---|
| Songlight 2920LQ | 0.5 | | | 0.5 | | 0.25 | 0.25 | 0.1 |
| Vanlube 961 | | 0.5 | | | 0.5 | 0.25 | 0.25 | 0.4 |
| Vanlube 7723 (30% S) | | | 0.5 | 0.5 | 0.5 | | 0.5 | 0.5 |
| Infineum C9268 | 3.9 | 3.9 | 3.9 | 3.9 | 3.9 | 3.9 | 3.9 | 3.9 |
| Durasyn 166 | 95.6 | 95.6 | 95.6 | 95.1 | 95.1 | 95.6 | 95.1 | 95.1 |
| PDSC @180° C. 500 lbs $O_2$ 100 ml/min flow Minutes to induction | 33.2 | 49.8 | 3.4 | 4.3 | 215.5 | 83.3 | 198.8 | 245.9 |

Example 7

Preparation of 2,2,6,6-Tetramethylpiperidinyl-4-dodecanoate

To a 100 mL round bottomed flask with a condenser attached was added 25.10 g of 2,2,6,6-tetramethyl-4-piperidinol, 39.90 g of methyl laurate, and 50 g of heptane. The mixture was heated until the piperidinol compound was melted, then 3.0 mL of 0.1M NaOMe in methanol was added. The mixture was heated to reflux and methanol distillate was collected until no more came over. The reaction was cooled somewhat, and the heptane solvent was removed by rotary evaporation, and the remaining colorless liquid was filtered through Celite to give 52.0 g of product.

Example 8

Lubricant Compositions Containing a Dodecyl Ester Hindered Amine, Octylated-Butylated Alkylated Diphenylamine, and Methylenebis(dibutyldithiocarbamate)

Lubricant compositions prepared as above in Example 1, containing the combination of a hindered amine, an octylated-butylated alkylated diphenylamine sold commercially as VANLUBE® 961, and Methylenebis(dibutyldithiocarbamate, sold commercially as VANLUBE® 7723. The hindered amine is 2,2,6,6-Tetramethylpiperidinyl-4-dodecanoate, a secondary amine containing a dodecyl ester in the 4 position of the ring. It was prepared as in Example W. The PDSC (ASTM D1686) was performed as in Example 1, and data is reported in Table "X".

TABLE VII

| | 1 | 2 | 3 | 4 | 5 | 6 | 7 | 8 |
|---|---|---|---|---|---|---|---|---|
| Example 7 Product, C12 HALS | 0.5 | | | 0.5 | | 0.25 | 0.25 | 0.1 |
| VL 961 | | 0.5 | | | 0.5 | 0.25 | 0.25 | 0.4 |
| VL 7723 (30% S) | | | 0.5 | 0.5 | 0.5 | | 0.5 | 0.5 |
| Infineum C9268 | 3.9 | 3.9 | 3.9 | 3.9 | 3.9 | 3.9 | 3.9 | 3.9 |
| Durasyn 166 | 95.6 | 95.6 | 95.6 | 95.1 | 95.1 | 95.6 | 95.1 | 95.1 |
| PDSC @180° C. 500 lbs $O_2$ 100 ml/min flow Minutes to induction | 21.9 | 70.2 | 21.4 | 26.5 | 330.5 | 15.8 | 319.2 | 432.7 |

Example 9

Lubricant Compositions Containing a Dodecyl Ester Hindered Amine, A Dioctylated Alkylated Diphenylamine, and Methylenebis(dibutyldithiocarbamate)

Lubricant compositions prepared as above in Example 1, containing the combination of a hindered amine, a dioctylated alkylated diphenylamine sold commercially as VANLUBE® 81, and Methylenebis(dibutyldithiocarbamate, sold commercially as VANLUBE® 7723. The hindered amine is 2,2,6,6-Tetramethylpiperidinyl-4-dodecanoate, a secondary amine containing a dodecyl ester in the 4 position of the ring. It was prepared as in Example 7. The PDSC (ASTM D1686) was performed as in Example 1, and data is reported in Table "VIII".

TABLE VIII

| | 1 | 2 | 3 | 4 | 5 | 6 | 7 |
|---|---|---|---|---|---|---|---|
| Example "7" Product, C12 HALS | 0.5 | | | | 0.25 | 0.25 | 0.1 |
| VL 81 | | 0.5 | | 0.5 | 0.25 | 0.25 | 0.4 |
| VL 7723 (30% S) | | | 0.5 | 0.5 | | 0.5 | 0.5 |
| Infineum C9268 | 3.9 | 3.9 | 3.9 | 3.9 | 3.9 | 3.9 | 3.9 |
| Durasyn 166 | 95.6 | 95.6 | 95.6 | 95.1 | 95.6 | 95.1 | 95.1 |
| PDSC @180° C. 500 lbs $O_2$ 100 ml/min flow Minutes to induction | 21.9 | 43.7 | 21.4 | 360.8 | 91.3 | 365.7 | 432.6 |

Example 10

Lubricant Compositions Containing a bis(2,2,6,6-tetramethyl-4-piperidyl)sebacate Hindered Amine, Octylated-Butylated Alkylated Diphenylamine, and Methylenebis(dibutyldithiocarbamate)

Lubricant compositions prepared as above in Example 1, containing the combination of a hindered amine, an octylated-butylated alkylated diphenylamine sold commercially as VANLUBE® 961, and Methylenebis(dibutyldithiocarbamate, sold commercially as VANLUBE® 7723. The hindered amine is bis(2,2,6,6-tetramethyl-4-piperidyl)sebacate, sold commercially as Songlight 7700. The PDSC (ASTM D1686) was performed as in Example 1, and data is reported in Table IX

TABLE IX

| | 1 | 2 | 3 | 4 | 5 | 6 | 7 |
|---|---|---|---|---|---|---|---|
| Songlight 7700 | 0.5 | | 0.5 | | 0.25 | 0.25 | 0.1 |
| VL 961 | | | | 0.5 | 0.25 | 0.25 | 0.4 |
| VL 7723 (30% S) | | 0.5 | 0.5 | 0.5 | | 0.5 | 0.5 |
| Infineum C9268 | 3.9 | 3.9 | 3.9 | 3.9 | 3.9 | 3.9 | 3.9 |
| Durasyn 166 | 95.6 | 95.6 | 95.1 | 95.1 | 95.6 | 95.1 | 95.1 |
| PDSC @180° C. 500 lbs $O_2$ 100 ml/min flow Minutes to induction | 34.7 | 21.4 | 7.5 | 330.5 | 7.3 | 265.8 | 336.1 |

What is claimed is:

1. A lubricating composition comprising at least 95% by weight of a lubricant basestock, and about 1-4% by weight of an antioxidant additive composition comprising:

(a) methylenebis(dibutyldithiocarbamate);

(b) a hindered amine selected from the group consisting of 4-stearoyloxy-2,2,6,6-tetramethylpiperidine, bis(2,2,6,6-tetramethylpiperidin-4-yl) sebacate, bis(1,2,2,6,6-pentamethylpiperidin-4-yl) sebacate and 2,2,6,6-tetramethylpiperidinyl-4-dodecanoate; and (c) a diaryl amine;

wherein the weight ratio of (a):(b):(c) is about 5:1:4.

2. The lubricating composition according to claim 1, wherein the additive composition comprises:

(a) the methylenebis(dibutyldithiocarbamate) at between about 0.5 and 2 wt %, (b) the hindered amine at between about 0.1 and 0.4 wt %, and (c) the diaryl amine at between about 0.4 and 1.6 wt %.

3. A lubricating composition comprising at least 95% by weight of a lubricant basestock, and about 1-4% by weight of an antioxidant additive composition comprising:

(a) methylenebis(dibutyldithiocarbamate) at between about 0.5 and 2 wt %, (b) a hindered amine selected from the group consisting of 4-stearoyloxy-2,2,6,6-tetramethylpiperidine and di(2,2,6,6-tetramethylpiperidin-4-yl) sebacate, at between about 0.1 and 0.4 wt %, and (c) a diaryl amine at between about 0.4 and 1.6 wt %;

wherein the weight ratio of (a):(b):(c) is about 5:1:4.

* * * * *